US009562376B2

(12) United States Patent
Dey

(10) Patent No.: US 9,562,376 B2
(45) Date of Patent: Feb. 7, 2017

(54) ANTI-RATTLE CLOSURE PANEL LATCH ASSEMBLY

(71) Applicant: Nissan North America, Inc., Franklin, TN (US)

(72) Inventor: Debraj Dey, Farmington Hills, MI (US)

(73) Assignee: NISSAN NORTH AMERICA, INC., Franklin, TN (US)

( * ) Notice: Subject to any disclaimer, the term of this patent is extended or adjusted under 35 U.S.C. 154(b) by 149 days.

(21) Appl. No.: 14/158,409

(22) Filed: Jan. 17, 2014

(65) Prior Publication Data

US 2015/0204120 A1 Jul. 23, 2015

(51) Int. Cl.

| | |
|---|---|
| ***E05B 15/02*** | (2006.01) |
| ***E05B 77/38*** | (2014.01) |
| ***E05B 85/04*** | (2014.01) |
| ***E05B 15/00*** | (2006.01) |

(52) U.S. Cl.

CPC ..... *E05B 77/38* (2013.01); *E05B 15/0006* (2013.01); *E05B 85/045* (2013.01); *Y10T 292/1075* (2015.04)

(58) Field of Classification Search

CPC .... E05B 15/02; E05B 15/022; E05B 15/0205; E05B 17/0045; E05B 77/36; E05B 77/38; E05B 15/0006; E05B 85/04; E05B 85/045; B60J 5/101

USPC ..... 292/340, 341, 341.12, 341.13, 341.14, 292/DIG. 56; 296/202, 207

See application file for complete search history.

(56) References Cited

U.S. PATENT DOCUMENTS

| | | | | |
|---|---|---|---|---|
| 6,155,618 | A | 12/2000 | Ichinose | |
| 8,128,138 | B2 | 3/2012 | Bambenek et al. | |
| 8,550,508 | B2 * | 10/2013 | Gentile et al. | 292/341.15 |
| 2007/0114802 | A1 | 5/2007 | Johnson et al. | |
| 2009/0212579 | A1 | 8/2009 | Hemingway et al. | |
| 2010/0283271 | A1 | 11/2010 | Hemingway et al. | |
| 2011/0025078 | A1 | 2/2011 | Gentile et al. | |
| 2011/0025079 | A1 * | 2/2011 | Paskonis | 292/341.15 |
| 2012/0112477 | A1 * | 5/2012 | Muramatsu et al. | 292/340 |
| 2013/0285395 | A1 * | 10/2013 | Burciaga et al. | 292/340 |

FOREIGN PATENT DOCUMENTS

| | | | | |
|---|---|---|---|---|
| FR | 2877971 | A1 * | 5/2006 | |
| FR | 2934229 | A1 * | 1/2010 | B25B 27/0035 |
| FR | 2982572 | A1 * | 5/2013 | E05B 85/045 |
| GB | EP 2940236 | A2 * | 11/2015 | E05B 77/38 |
| JP | 2012097495 | A | 5/2012 | |
| WO | 2009075842 | A1 | 6/2009 | |
| WO | WO 2011156382 | A1 * | 12/2011 | |

* cited by examiner

*Primary Examiner* — Alyson M Merlino

(74) *Attorney, Agent, or Firm* — Global IP Counselors, LLP

(57) ABSTRACT

A closure panel latch assembly for a vehicle closure panel, includes a mounting plate, a striker bar, and a bumper. The mounting plate includes a first surface, and a bumper flange. The striker bar extends from the first surface of the mounting plate and is spaced from the bumper flange. The bumper includes a base portion and first and second retention members, the base portion being configured to be disposed on the bumper flange, and the first and second retention members extending from first and second sides of the base portion, respectively, and having first and second distal ends on opposing sides of the striker bar.

20 Claims, 7 Drawing Sheets

75
22
76
90
92

76
89
80
76a
R3
81
90
84
75
22
93a
93c
93
93b
86
87
R4
78
82
78a 22
75
93a
93c
110
108
104
106
93b
112
90
92

76
89
93a
93
92
94
22
110
93c
93b
104
75
78

93a
76
22
75
93c
114
112
104
108
90
93
93b
78

ANTI-RATTLE CLOSURE PANEL LATCH ASSEMBLY

BACKGROUND

Field of the Invention

The present invention generally relates to a bumper for a closure panel of a vehicle. More specifically, the present invention relates to a bumper that attaches to a flange on a mounting plate to control closure panel movement.

Background Information

Vehicles typically have several closure panels, such as doors for accessing a passenger compartment, and lift gates for accessing cargo areas. Conventional vehicle lift gates generally have two side bumpers positioned along the lift gate opening perimeter on the vehicle body. The bumpers are strips of rubber that attempt to prevent lift gate rattle and movement. However, the conventional bumpers do not effectively restrict lift gate movement in the vehicle longitudinal (X) direction and the vehicle width (Y) direction.

Additionally, many conventional vehicle lift gates include an over slam stopper that is installed on a vehicle body. The over slam stopper contacts a protrusion when the lift gate closes. The over slam stopper deforms when the lift gate closes to absorb impact shock, minimize impact noise, and avoid excessive insertion of the lift gate. However, as with the side bumpers, the over slam stopper does not restrict lift gate movement in the vehicle longitudinal (X) direction and the vehicle width (Y) direction.

Accordingly, to further advance lift gate stability, a need exists for an improved bumper for a lift gate.

SUMMARY

It has been discovered that to reduce lift gate movement, and thus possible rattle during off-road driving conditions, a bumper that contours to an outer surface of the latch housing can be attached to a flange on a mounting plate for a striker bar.

In one disclosed embodiment, a closure panel latch assembly for a vehicle closure panel, comprises a mounting plate, a striker bar, a bumper flange extending from the mounting plate, and a bumper. The mounting plate includes a first surface, and the striker bar extends from the first surface of the mounting plate and is spaced from the bumper flange. The bumper comprises a base portion, a first retention member having a first distal end and extending from a first side of the base portion, and a second retention member having a second distal end and extending from a second side of the base portion opposite the first side, the base portion being configured to be positioned on the bumper flange with the first and second distal ends positioned on opposing sides of the striker bar.

In another disclosed embodiment, a vehicle lift gate assembly comprises a body structure, a closure panel latch assembly, and a lift gate. The body structure defines a lift gate opening. The lift gate is disposed on the body structure and is movable between an open position exposing the lift gate opening and a closed position concealing the lift gate opening. The closure panel latch assembly comprises a mounting plate mounted to the body structure and having a first surface, a bumper flange extending from the mounting plate, a striker bar extending from the first surface of the mounting plate and spaced from the bumper flange, and a bumper. The bumper comprises a base portion, a first retention member having a first distal end and extending from a first side of the base portion, and a second retention member having a second distal end and extending from a second side of the base portion opposite the first side, the base portion being configured to be disposed on the bumper flange with the first and second distal ends positioned on opposing sides of the striker bar. The latch structure is on the lift gate, and comprises a latch configured to engage the striker bar to retain the lift gate in the closed position, and a latch housing covering at least a portion of the latch member, the latch housing being positioned between the first and second retention members when the lift gate is in the closed position. The bumper is configured and arranged to form an interference fit with the latch housing.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1B:
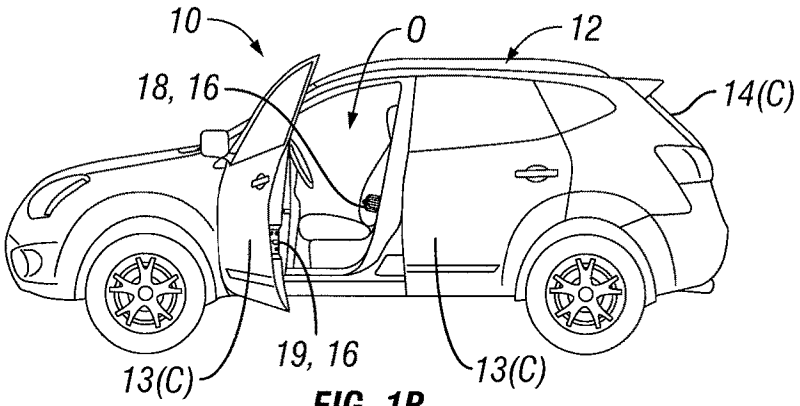
FIG. 1B illustrates a side view of the vehicle showing a door in an open position exposing a closure panel opening and a closure panel latch assembly according to the present invention.
Figure 1A:
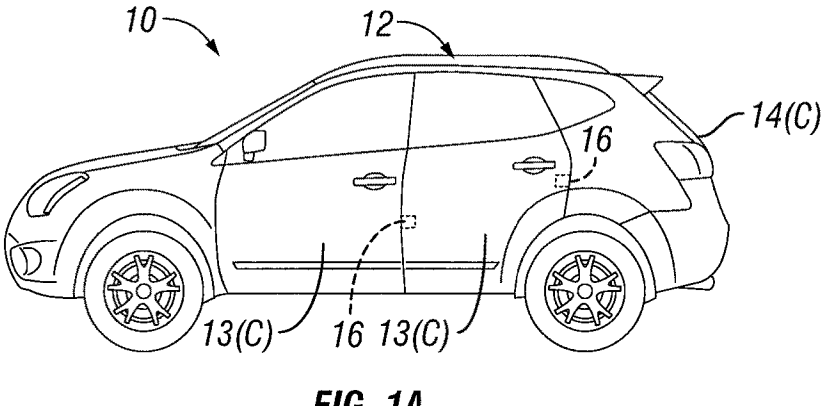
FIG. 1A illustrates a side view of a vehicle with closure panels in respective closed positions according to one embodiment of the present invention.
Figure 1D:
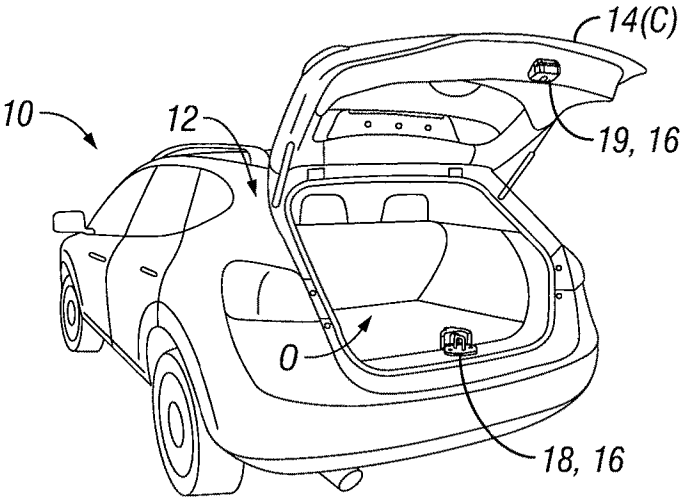
FIG. 1D illustrates a rear perspective view of the vehicle lift gate in an open position exposing a closure panel opening and a closure panel latch assembly according to the present invention.
Figure 1C:
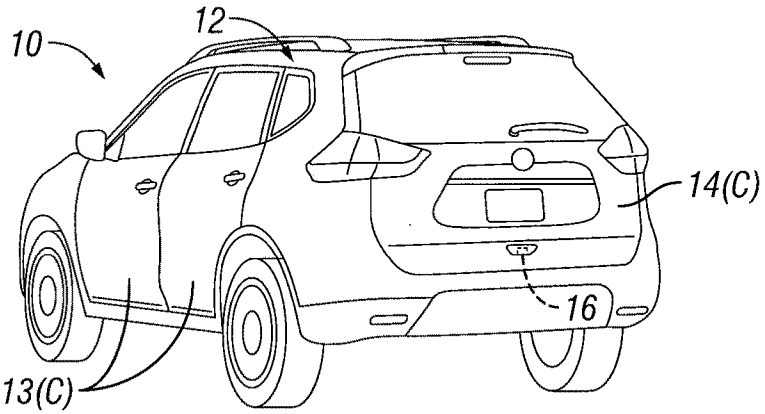
FIG. 1C illustrates a rear perspective view of the vehicle with a lift gate in the closed position.

Referring initially to FIGS. 1A-D, a vehicle 10 is shown having a body structure 12 defining multiple closure panel openings O. The vehicle 10 further includes multiple closure panels C that are movable between a closed position (FIGS. 1A and 1C) in which the closure panels C conceal the closure panel openings O, and an open position (FIGS. 1B and 1D) in which the closure panels C expose the closure panel openings O. Examples of closure panels C include doors 13 (FIGS. 1A and 1B) for accessing a passenger compartment area of the vehicle 10, and a lift gate 14 (FIGS. 1C and 1D) for accessing a cargo area of the vehicle 10. The closure panels C can be retained in their closed positions by a closure panel latch assembly 16 as described herein, which may be visible when the closure panels C are in their open positions as shown in FIGS. 1B and 1D.

FIGS. 2-5 illustrate an anti-rattle closure panel latch assembly 16 for retaining the lift gate 14 in the closed position in accordance with an embodiment. While the closure panel latch assembly 16 is described in detail below with specific reference to the lift gate 14, and referred to as a lift gate latch assembly 16, it is noted that the structure of the closure panel latch assembly 16 could also be reoriented and positioned on the vehicle 10 to retain one of the doors 13 in the closed position.

In particular, the lift gate 14 is attached to an upper portion of the body structure 12 by a hinge (not shown) to be movable between the closed and open positions, and the lift gate closure panel latch assembly 16 is disposed on a lower portion of body structure 12 of the vehicle 10 to retain the lift gate 14 in the closed position. That is, the lift gate 16 is in general on a rear portion of the vehicle 14 and is configured to swing from a lowered position to a raised position so as to enable access to a storage area or a rear portion of the vehicle. However, it is noted that the lift gate 16 (or door 13) can be disposed on any suitable portion of vehicle 16 and may swing or open in any suitable manner.

Figure 2:
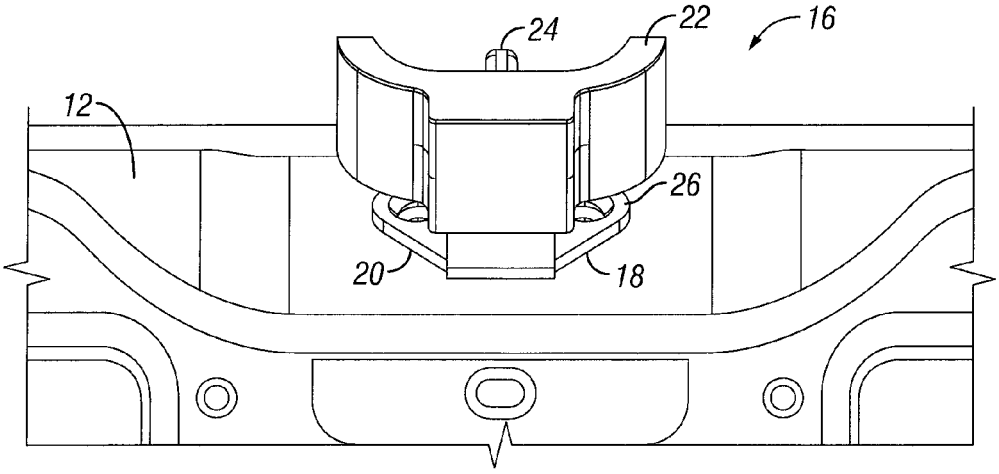
FIG. 2 is an enlarged forward perspective view of the closure panel latch assembly shown in FIG. 1D.
Figure 3:
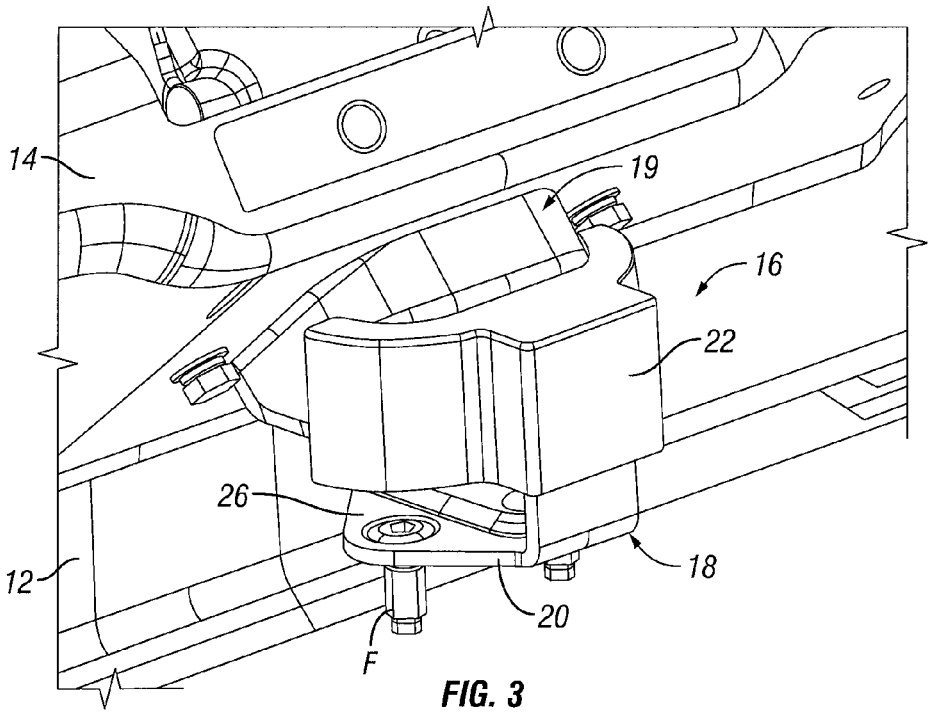
FIG. 3 is a side perspective view of closure panel latch assembly shown in FIG. 2, with the body structure removed.

As shown in FIGS. 2 and 3, the anti-rattle lift gate latch assembly 16 includes a striker assembly 18 on the body structure 12 and a latch structure 19 on the lift gate 14. The striker assembly 18 comprises a mounting plate 20, a bumper 22, and a striker bar 24. Generally, the mounting plate 20 of the striker assembly 18 is coupled to the body structure 12 of the vehicle 14 using a mechanical fastener F, or may otherwise be rigidly attached to the body structure by welding, for example. The striker bar 24 extends upwardly from a first surface 26 of the mounting plate 20 and has a configuration that would enable the latch structure 19 attached to the lift gate 14 to couple thereto. This configuration enables the lift gate 14 to latch to the lower body structure 12 of the vehicle 10, maintaining a secure closure for the lift gate opening O of the vehicle 10.

Figure 6:
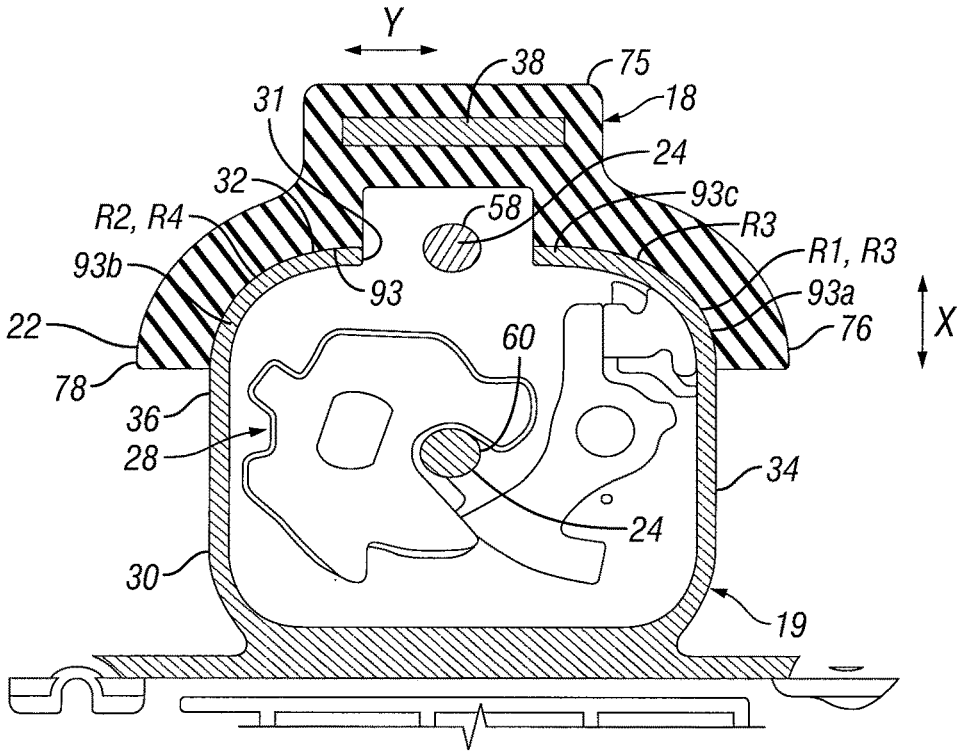
FIG. 6 is a cross-sectional view of the closure panel latch assembly taken along line 6-6 in FIG. 5.

The latch structure 19 is movable with the lift gate 14 relative to the striker assembly 18 and comprises a latch 28 configured to engage the striker bar 24 to retain the lift gate 14 in the closed position, and a latch housing 30 at least partially surrounding the latch member or latch 28 (FIG. 6). Thus, the latch housing 30 covers at least a portion of the latch 28. The operation and internal structure of the latch 28 is conventional and therefore is not described herein.

Figure 4:
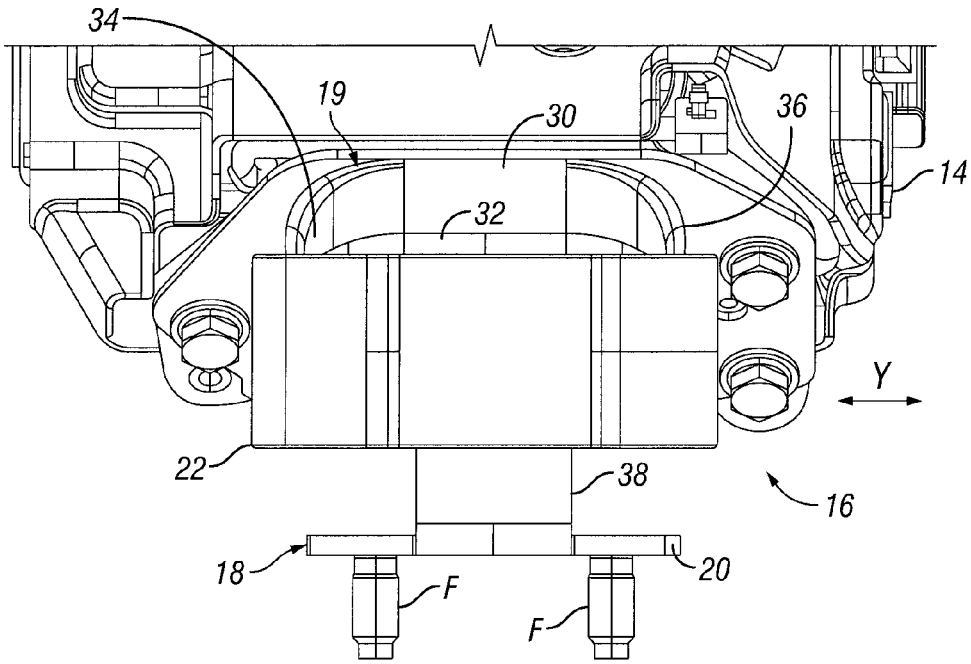
FIG. 4 is a rear plan view of closure panel latch assembly shown in FIG. 2, with the body structure removed.
Figure 5:
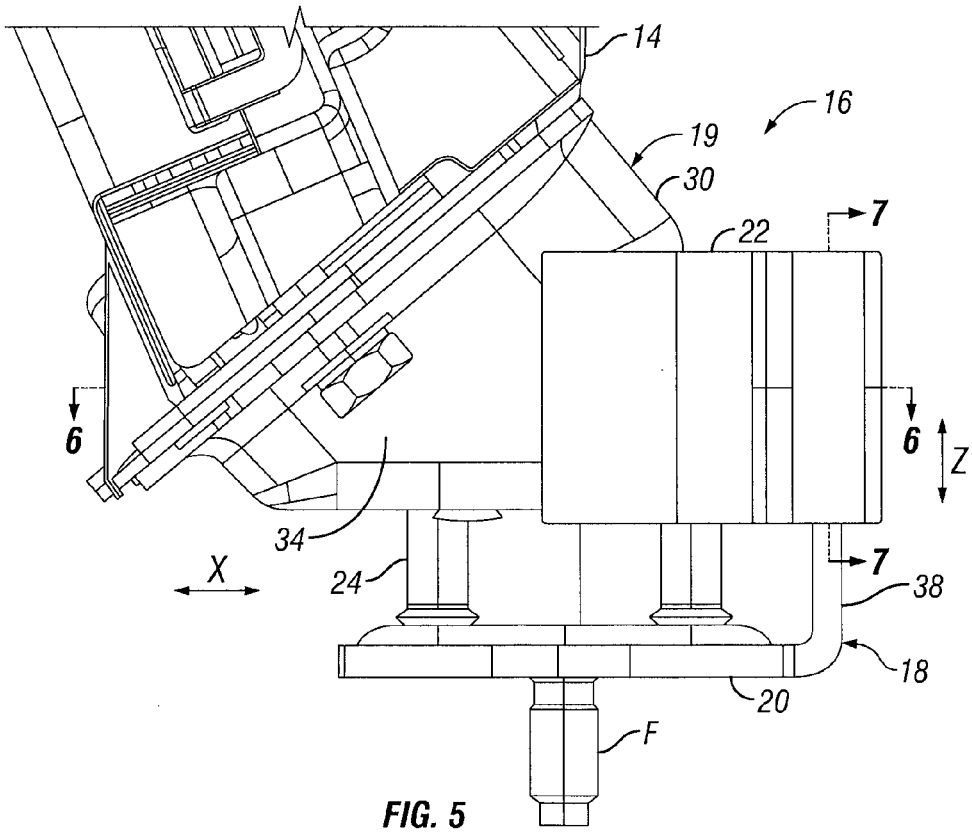
FIG. 5 is a side plan view of the closure panel latch assembly shown in FIG. 2 with the body structure removed.

The bumper 22 of the striker assembly 18 is configured and arranged to form an interference fit with the latch housing 30. That is, as shown in FIGS. 3-6, when the lift gate 14 is in a closed position, the bumper 22 contacts or forms an interference fit with the latch housing 30 of the latch structure 19 to reduce or eliminate movement of the lift gate 14 in the vehicle longitudinal (X) direction and the vehicle width (Y) direction. The latch housing 30 further defines a striker receiving slot 31 such that when the lift gate 14 is in the closed position and the latch 28 is in the latched configuration (FIG. 6), as shown in FIGS. 3-5, the striker bar 24 extends partially within the latch housing 30 through the striker receiving slot 31 and partially outside of latch housing 30 in the vehicle longitudinal (X) and vehicle vertical (Z) directions.

As shown in FIGS. 4-6, the latch housing 30 has a front surface 32, a first side surface 34, and a second side surface 36. The front surface 32 and first side surface 34 of the latch housing 30 define a predetermined first radius R1, and the front surface 32 and second side surface 36 of the latch housing 30 define a predetermined second radius R2.

FIGS. 8-17 illustrate the striker assembly 18, which includes the striker bar 24, the mounting plate 20, a bumper flange 38, and the bumper 22. The mounting plate 20 includes the first surface 26, a second surface 42 and a perimeter edge 44 extending between the first surface 26 and the second surface 42, and surrounding the first surface 26. The mounting plate 20 may have any suitable shape, such as a generally rectangular or square shape or have six or more sides. Moreover, the mounting plate 20 may include openings 45 (two shown) that extend from the first surface 40 to the second surface 42. Openings 45 receive the fasteners F to couple the striker assembly 18 to the vehicle body structure 12 (FIG. 2). The first surface 26 and the second surface 42 of the mounting plate 20 are substantially planar and substantially parallel to each other.

In this embodiment, the bumper flange 38 extends from the perimeter edge 44 of the mounting plate 20; however, the bumper flange 38 may extend from any suitable portion of the mounting plate, such as the first surface 26. In this embodiment, the bumper flange 38 extends from the perimeter edge 44, along a rearward or outermost side with respect to the vehicle when installed to the body structure 12, and has a width generally the same as the side from which it extends. The bumper flange 38 may extend substantially perpendicularly to the mounting plate 20, and has a first surface 46 facing the striker bar 24, a second surface 48 opposite the first surface 46, a first side edge 50, a second side edge 52, and a top edge 54 at a distal end 55 opposite the first surface 26 of the mounting plate 20. Each of the first side edge 50, second side edge 52, and top edge 54 extends from the first surface 46 to the second surface 48. In this embodiment, the first surface 46 and second surface 48 of the bumper flange 38 have generally rectangular shapes. However, the bumper flange 38 may have any suitable configuration, and the bumper flange 38 may be one of a plurality of bumper flanges 38.

Figure 7:
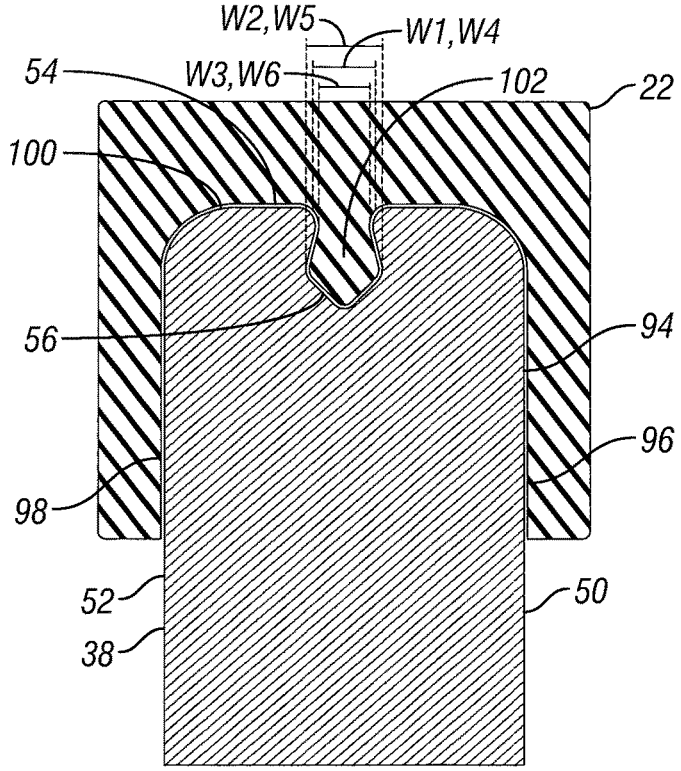
FIG. 7 is a cross-sectional view of the closure panel latch assembly taken along line 7-7 in FIG. 5.

The top edge 54 of bumper flange 38 defines a retention slot 56 disposed or located thereon. The retention slot may vary in width between the first side edge 50 and second side edge 52 along its length. That is, the retention slot 56 may extend from the top edge 54 toward the mounting plate 20 in a length direction, and extend from the first surface 46 to the second surface 48 in a depth direction. The retention slot 56 defines a first predetermined width W1 adjacent the top edge 54 and a second predetermined width W2 closer to the mounting plate 26 that is greater than the first predetermined width W1 (FIG. 7). Further, the retention slot 56 can define a third width W3 further from the top edge 54 and less than the second predetermined width W2. It is noted that the retention slot 56 may have any suitable shape, such as an increased width at the top edge 54 and a decreased width closer to the mounting plate 26 (see FIGS. 7 and 14), forming a generally diamond or rectangular shape.

The striker bar 24 may be formed of any suitable metal material, and preferably extends from the first surface 26 of the mounting plate 20, and is spaced from the bumper flange 38; however, the striker bar 24 may extend from any suitable portion of the mounting plate 20. In this embodiment, the striker bar has a first portion 58, a second portion 60 and a third portion 62. The first portion 58 is disposed closest to the bumper flange 38 and has a first end 64 and a second end 66. The first end 64 of the first portion 58 is non-detachably fixed to the first surface 26 of the mounting plate 20 and the first portion 58 extends substantially perpendicularly from the first surface 26 of the mounting plate 20. The second portion 60 is disposed in a position spaced from the bumper flange 38 and has a first end 68 and a second end 70. The first end 68 of the second portion 60 is non-detachably fixed to the first surface 26 of the mounting plate 20 and the second portion 60 extends substantially perpendicularly from the first surface 26 of the mounting plate 20. The third portion 62 has a first end 72 and a second end 74. The first end 72 of the third portion 62 is non-detachably fixed to the second end 66 of the first portion 58, and the second end 74 of the third portion 62 is non-detachably fixed to the second end 70 of the second portion 60. The third portion 62, thus extends between the first portion 58 and the second portion 60 and is substantially perpendicular to each of the first and second portions 58 and 60. Moreover, in this embodiment, the third portion 62 is substantially parallel to a plane defined by the first surface 26 of the mounting plate 20.

Figure 15:
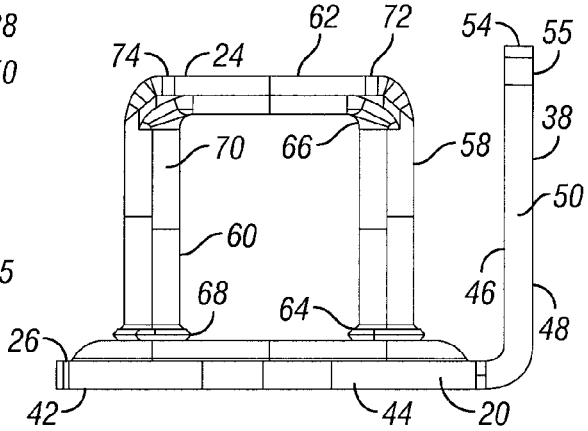
FIG. 15 is a side view of the striker assembly shown in FIG. 14 with the bumper removed.
Figure 16:
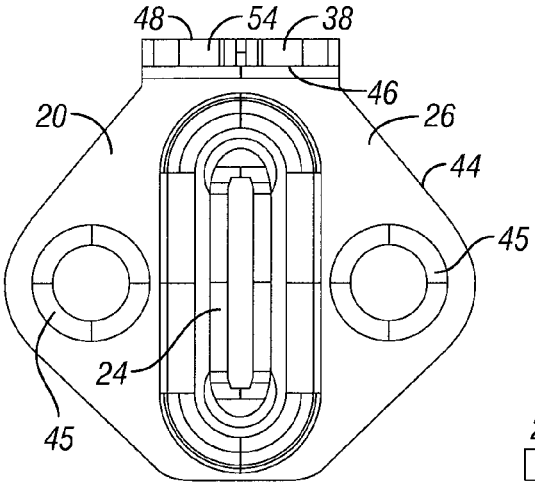
FIG. 16 is a top view of the striker assembly shown in FIG. 14 with the bumper removed.
Figure 17:
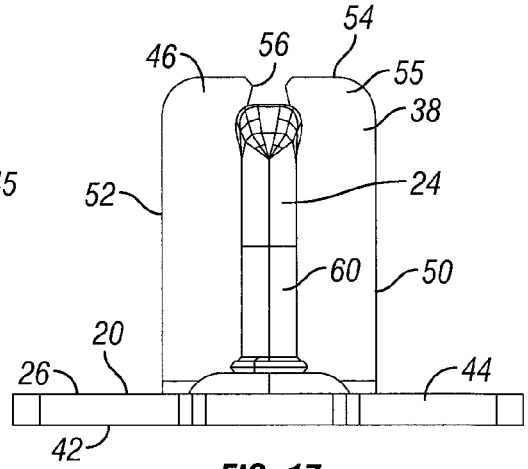
FIG. 17 is a front view of the striker assembly shown in FIG. 14 with the bumper removed.

Thus, as shown in FIG. 15, the striker bar 24 has a generally U-shaped configuration and extends from the first portion 58 that is proximate to the bumper flange 38 to the second portion 60 which at least partially extends through the striker receiving slot 31 of the latch housing 30 (FIG. 5) when the lift gate 14 is in the closed position. This structure enables the latch 28 to engage the striker bar 24, such as the second portion 60 and/or the third portion 62, enabling effective latching of the lift gate 14 (See FIG. 6). Moreover, each of the first portion 58, second portion 60 and third portion 62 are substantially cylindrical. However, the striker bar 24 may have any suitable structure or configuration.

FIGS. 8-12 illustrate the bumper 22, which may be made of rubber or any suitable resilient material. The bumper 22 includes a base portion 75, a first retention member 76 and a second retention member 78. The bumper 22 also includes a top surface 90, a bottom surface 92, an exterior surface 89, and an interior surface 93. In this embodiment, the interior surface 93 has a first portion 93*a* extending along the first retention member 76, a second portion 93*b* extending along the second retention member 78, and a third portion 93*c* extending along the base portion 75. The first portion 93*a* and third portion 93*c* of the interior surface 93 define a predetermined third radius R3 corresponding to the first radius R1 of the latch housing 30, and the second portion 93*b* and third portion 93*c* of the interior surface 93 define a predetermined fourth radius R4 corresponding to the second radius R2 of the latch housing 30 (FIG. 6).

The base portion 75 has a substantially rectangular cross-sectional height and width. That is, the base portion 75 extends outwardly from the first and second retention members 76, 78 to form a rectangular shaped projection. The base portion 75 has a first side 84 from which the first retention member 76 extends, and a second side 86 from which the second retention member 78 extends. The bottom surface 92 of the bumper 22 at the base portion 74 defines a mounting recess 94 for receiving the bumper flange 38.

Figure 8:
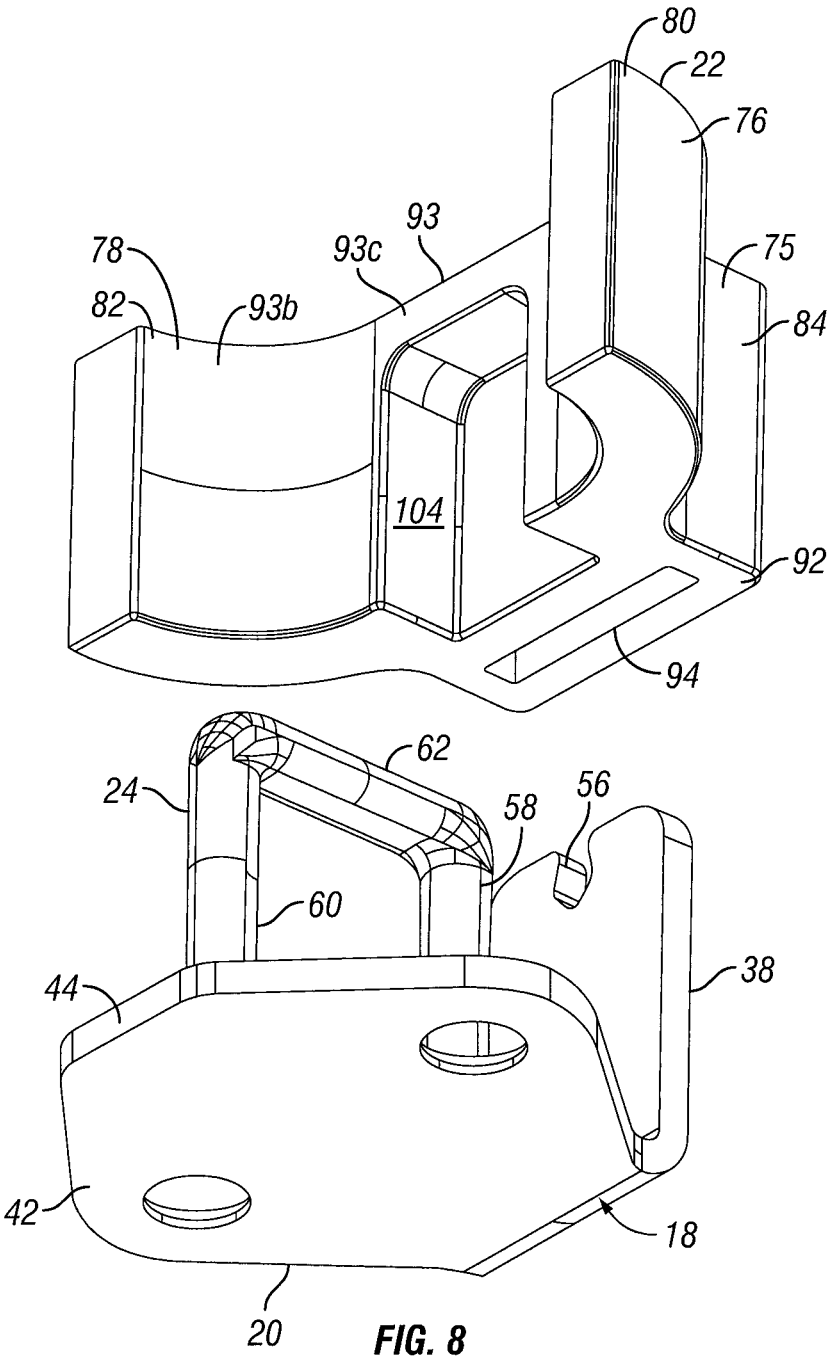
FIG. 8 is an exploded perspective view of a striker assembly of the closure panel latch assembly shown in FIG. 2.
Figures 9, 10, 11, 12, 13:
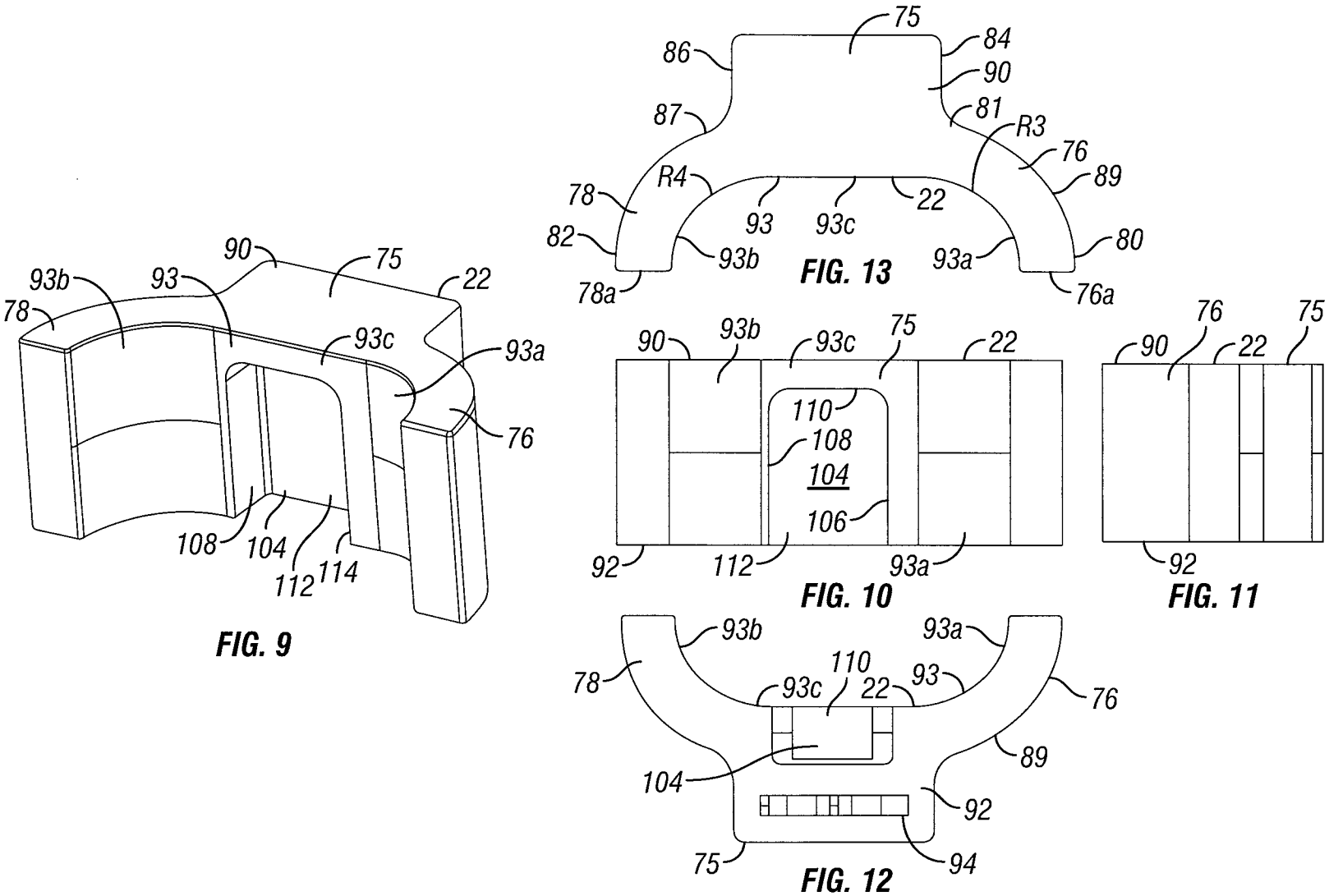
FIG. 9 is a top perspective view of a bumper of the striker assembly shown in FIG. 8.
FIG. 10 is a front plan view of the bumper shown in FIG. 9.
FIG. 11 is a side plan view of the bumper shown in FIG. 9.
FIG. 12 is a bottom view of the bumper shown in FIG. 9.
FIG. 13 is a top view of the bumper shown in FIG. 9.
Figure 14:
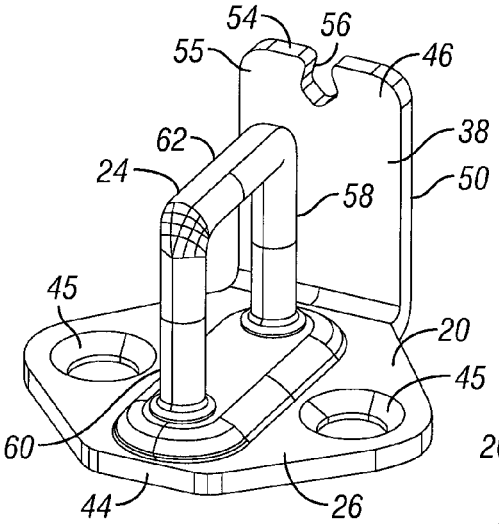
FIG. 14 is a top perspective view of the striker assembly shown in FIG. 8 with the bumper removed.

That is, as shown in FIGS. 8 and 12, the mounting recess 94 is a substantially rectangular opening having a perimeter that is approximately the same size and shape as the perimeter of the bumper flange 38. Moreover, as illustrated in FIG. 7, the mounting recess 94 has a substantially rectangular configuration that is approximately the same size and shape as the mounting flange 38.

As shown in FIG. 7, the mounting recess 94 has a first internal side 96, a second internal side 98 and a third or top internal side 100. That top internal side 100 includes a retention projection 102 extending therefrom in the direction of the opening of the mounting recess 94. The retention projection 102 is sized and configured to be received in the retention slot 56 of the bumper flange 38. The retention projection 102 has a shape complementary to the shape of the retention slot 56. That is, similar to the retention slot 56, the retention projection 102 varies in width along its length. The retention projection 102 defines a first predetermined width W4 adjacent the top internal side 100 and a second predetermined width W5 closer to the opening of the mounting recess 94 that is greater than the first predetermined width W4. Further, the retention projection 102 can define a third width W6 further from the top internal side 100 and less than the second predetermined width W5. It is noted that the retention projection 102 may have any suitable shape, such as an increased width immediately adjacent the top internal side 100 and a decreased width closer to the opening of the mounting recess 94 (see FIG. 7), forming a generally diamond or rectangular shape.

Turning to FIG. 13, the first retention member 76 has a first distal end 80, a first proximal end 81 and a first end surface 76*a*. The first retention member 76 extends from the first side 84 of the base portion 75 at the first proximal end 81. The first end surface 76*a* is generally perpendicular to the interior surface 93 at the first distal end 80. The second retention member 78 has a second distal end 82, a second proximal end 87, and a second end surface 78*a*. The second retention member 78 extends from the second side 86 of the base portion 75 at the second proximal end 87. The end surface 78*a* is generally perpendicular to the interior surface 93 at the second distal end 82. Each of the retention members preferably has a substantially constant thickness of about 6-12 mm from the proximal ends 81 and 87 to the distal ends 80 and 82, more preferably about 8-12 mm and optimally 10 mm, but may have any desired thickness. Moreover, if desired, the thickness may vary from the proximal ends 81 and 87 to the distal ends 80 and 82 of the retention members 76 and 78, enabling a variance in the stiffness of the retention members 76 and 78 along their length.

As illustrated in FIGS. 12 and 13, each of the retention members 76 and 78 have an arcuate shape, such that the retention members 76 and 78 may curve inwardly toward each other. Each of the retention members 76 and 78 extend such that the respective end surfaces 76*a* and 78*a* are substantially coplanar. However, the configuration of the retention members may be any suitable configuration.

As illustrated in FIGS. 10 and 11, the bumper 22 generally has a consistent height. That is, top surface 90 is generally parallel to bottom surface 92. The height of the bumper 22 is such that the bumper extends about 75%-80% of a height of the front surface 32 of the latch housing 30, as shown in FIGS. 4 and 5. However, the height of the bumper 22 may be any suitable height.

Additionally, in this embodiment, as shown in FIGS. 5, 8-10, and 12, the interior surface 93 of the bumper 22 defines a striker recess 104 so as to have at least a portion (e.g., first portion 58) of the striker bar 24 positioned therein when the base portion 75 of the bumper 22 is positioned on the bumper flange 38. That is, as discussed above, since the striker bar 24 is positioned partially outside of the latch housing 30 when the lift gate 14 is in the closed position and the latch structure 19 is coupled to the striker assembly 18, the striker recess 104 enables the bumper 22 to contact the latch housing 30, as described herein.

As shown in FIGS. 9, 10 and 12, the striker recess 104 is substantially rectangular and has a first side 106, a second side 108, a third side 110, and a surface 112 that is arranged to face the striker bar 24. The striker recess 104 has an opened portion 114 at the bottom surface 92. The striker recess 104 generally has an area that is substantially the same as the striker receiving slot 31 in the latch housing 30. The distance from the mounting recess 94 to the striker recess 104 is about 5 mm, and the distance from the mounting recess 94 to the exterior surface 89 is about 5 mm.

As shown in FIG. 8, the base portion 75 of the bumper 22 is configured to be positioned on the bumper flange 38 with the first and second distal ends 80, 82 positioned on opposing sides of the striker bar 24. Further, the bumper 22 is detachably attached to the bumper flange 38. In particular, the bumper 22 may be coupled to the bumper flange 38 by inserting the bumper flange 38 into the mounting recess 94. The retention projection 102 deforms such that the second predetermined width B of the retention projection 102 deforms as it passes through the first predetermined width W1 of the retention slot 56. As the retention projection 102 is further inserted into the retention slot 56, the retention projection 102 returns to its original shape when the second predetermined width W5 of the retention projection 102 aligns with the second predetermined width W2 of the retention slot 56. Thus, the bumper 22 is fixed to the bumper flange 38 in a manner that requires significant force to remove the bumper 22 from the bumper flange 38.

As shown in FIG. 2-5, the bumper 22 preferably is positioned above and spaced from the mounting plate 20, but below the latch housing 30. In the configuration and arrangement of this embodiment, as described above, the bumper 22 is configured to extend to a height that is about 75%-80% of a height of the front surface 32 of the latch housing 30, when the lift gate 14 is in the closed position. However, the bumper 22 may have any suitable height desired. This arrangement reduces the amount of material needed for the bumper 22, while still resulting in sufficient contact of the interior surface 93 to the front surface 32, the first side surface 34, and the second side surface 36 of the latch housing 30.

Moreover, as shown in FIG. 6, the first portion 93*a* of the interior surface 93 contacts the first side surface 34 of the latch housing 30, the second portion 93*b* of the interior surface 93 contacts the second side surface 36 of the latch housing 30, and third portion 93*c* of the interior surface 93 contacts the front surface 32 of the latch housing 30. In this embodiment, each of the first portion 93*a* and the second portion 93*b* of the interior surface 93 extend at least 2 mm along the first side surface 34 and the second side surface 36, respectively. However, the respective interior surfaces may extend as far as desired.

The first and second retention members 76 and 78 are configured such that when the interior surface 93 of the bumper is in contact with the latch housing 30, as described above, the latch housing 30 is positioned between the first and second retention members 76 and 78 when the lift gate 14 is in the closed position. Thus, the retention members 76 and 78 push inwardly on the latch housing 30. In other words, the third radius R3 and the fourth radius R4 defined by the portions of the interior surface are the same or slightly less than the first radius R1 and the second radius R2 defined by the latch housing 30. This structure and arrangement results in an interference fit between the bumper 22 and the latch housing 30 that reduces or eliminates lift gate movement in the vehicle longitudinal (X) direction and the vehicle width (Y) direction while the lift gate 14 is in the closed position.

If desired, material may be removed from the first and second retention members 76 and 78 to tune their stiffness. For example, holes can be formed (e.g., drilled) in the first and second retention members 76 and 78 to reduce stiffness. Such a structure would enable a variance in the stiffness of the retention members 76 and 78 to enable the embodiment to adjust to specific vehicle latch housings 30.

The latch 28, the vehicle body structure 12, and the closure panels C (doors 13 and lift gate 14) are conventional components that are well known in the art. Since these components are well known in the art, the details of these structures will not be discussed or illustrated in detail herein. Rather, it will be apparent to those skilled in the art from this disclosure that the components can be any type of structure that can be used to carry out the present invention. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), the following directional terms "top", "bottom" and "front", as well as any other similar directional terms refer to those directions of a vehicle equipped with the Anti-Rattle Lift Gate Striker. Accordingly, these terms, as utilized to describe the present invention should be interpreted relative to a vehicle equipped with the Anti-Rattle Lift Gate Striker.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A closure panel latch assembly for a vehicle closure panel, comprising: a mounting plate including a first surface, and a bumper flange; a striker bar extending from the first surface of the mounting plate, and being spaced from the bumper flange, the striker bar including a first portion extending substantially parallel to the first surface of the mounting plate and having a length defining a longitudinal axis; and a bumper comprising a base portion, a first retention member having a first distal end and extending from a first side of the base portion, and a second retention member having a second distal end and extending from a second side of the base portion opposite the first side, the base portion being configured to be disposed on the bumper flange by the bumper flange being positioned within a mounting recess defined in the base portion such that the first and second distal ends are positioned on opposing sides of the longitudinal axis, the bumper flange extending substantially perpendicularly from the first surface of the mounting plate to a distal free end, and including a portion that is substantially parallel to at least a part of the striker bar.

2. The closure panel latch assembly according to claim 1, wherein the mounting plate includes a perimeter edge surrounding the first surface, and the bumper flange extends from the perimeter edge of the mounting plate.

3. The closure panel latch assembly according to claim 1, wherein the base portion has a retention projection in the mounting recess, and the bumper flange includes a retention slot configured to receive the retention projection with the bumper flange positioned within the mounting recess.

4. The closure panel latch assembly according to claim 3, wherein the retention projection and the retention slot vary in width along respective lengths thereof.

5. The closure panel latch assembly according to claim 3, wherein the bumper flange has a distal end opposite the first surface of the mounting plate, with the retention slot located at the distal end of the bumper flange.

6. A closure panel latch assembly for a vehicle closure panel, comprising: a mounting plate including a first surface, and a bumper flange; a striker bar extending from the first surface of the mounting plate, and being spaced from the bumper flange, the striker bar including a first portion extending substantially parallel to the first surface of the mounting plate and having a length defining a longitudinal axis; and a bumper comprising a base portion, a first retention member having a first distal end and extending from a first side of the base portion, and a second retention member having a second distal end and extending from a second side of the base portion opposite the first side; the base portion being configured to be disposed on the bumper flange by the bumper flange being positioned within a mounting recess defined in the base portion such that the first and second distal ends are positioned on opposing sides of the longitudinal axis, the bumper flange extending substantially perpendicularly from the first surface of the mounting plate and including a portion that is substantially parallel to at least a part of the striker bar, the bumper has: an interior surface extending continuously along the base portion, the first retention member, and the second retention member, and a striker recess formed in the interior surface, the striker recess configured to have at least a portion of the striker bar positioned therein between the first retention member and the second retention member when the base portion of the bumper is positioned on the bumper flange.

7. The closure panel latch assembly according to claim 6, wherein the striker bar has a second portion extending substantially perpendicularly from the first surface of the mounting plate and a third portion extending substantially perpendicularly from the first surface of the mounting plate, and the first portion extends between the second portion and the third portion, wherein the striker recess is configured to receive at least the second portion of the striker bar.

8. The closure panel latch assembly according to claim 1, further comprising:

a latch structure movable relative to the striker bar and comprising a latch configured to engage the striker bar and a latch housing at least partially surrounding the latch, wherein the bumper is configured and arranged to form an interference fit with an exterior of the latch housing.

9. A vehicle lift gate assembly comprising:

a body structure defining a lift gate opening;

a lift gate disposed on the body structure and being movable between an open position exposing the lift gate opening and a closed position concealing the lift gate opening;

a closure panel latch assembly comprising:

a mounting plate mounted to the body structure and having a first surface, a bumper flange extending from the mounting plate, a striker bar extending from the first surface of the mounting plate, the striker bar being spaced from the bumper flange, the striker bar including a first portion extending substantially parallel to the first surface of the mounting plate and having a length defining a longitudinal axis, and a bumper comprising a base portion, a first retention member having a first distal end and extending from a first side of the base portion, and a second retention member having a second distal end and extending from a second side of the base portion opposite the first side, the base portion being configured to be disposed on the bumper flange with the first and second distal ends positioned on opposing sides of the longitudinal axis, the bumper flange extending substantially perpendicularly from the first surface of the mounting plate to a distal free end, and including a portion that is substantially parallel to at least a part of the striker bar; and a latch structure on the lift gate comprising:

a latch configured to engage the striker bar to retain the lift gate in the closed position, and a latch housing covering at least a portion of the latch, the latch housing being positioned between the first and second retention members when the lift gate is in the closed position, wherein the bumper is configured and arranged to form an interference fit with the latch housing.

10. The vehicle lift gate assembly according to claim 9, wherein the mounting plate includes a perimeter edge surrounding the first surface, and the bumper flange extends from the perimeter edge of the mounting plate.

11. The vehicle lift gate assembly according to claim 9, wherein the base portion defines a mounting recess configured to receive the bumper flange.

12. The vehicle lift gate assembly according to claim 11, wherein the base portion has a retention projection in the mounting recess, and the bumper flange includes a retention slot configured to receive the retention projection with the bumper flange positioned within the mounting recess.

13. The vehicle lift gate assembly according to claim 12, wherein the retention projection and the retention slot vary in width along respective lengths thereof.

14. The striker assembly according to claim 12, wherein the bumper flange has a distal end opposite the first surface of the mounting plate, with the retention slot located at the distal end of the bumper flange.

15. The vehicle lift gate assembly according to claim 9, wherein the bumper has an interior surface extending continuously along the base portion, the first retention member, and the second retention member, and the interior surface defines a striker recess configured to have at least a portion of the striker bar positioned therein between the first retention member and the second retention member when the base portion of the bumper is positioned on the bumper flange.

16. The vehicle lift gate assembly according to claim 15, wherein the striker bar has a second portion extending substantially perpendicularly from the first surface of the mounting plate, a third portion extending substantially perpendicularly from the first surface of the mounting plate, and the first portion extends between the second portion and the third portion, wherein the striker recess is configured to receive at least the second portion of the striker bar.

17. A vehicle lift gate assembly comprising:

a body structure defining a lift gate opening;

a lift gate disposed on the body structure and being movable between an open position exposing the lift gate opening and a closed position concealing the lift gate opening;

a closure panel latch assembly comprising:

a mounting plate mounted to the body structure and having a first surface, a bumper flange extending from the mounting plate, a striker bar extending from the first surface of the mounting plate, the striker bar being spaced from the bumper flange, the striker bar including a first portion extending substantially parallel to the first surface of the mounting plate and having a length defining a longitudinal axis, and a bumper comprising a base portion, a first retention member having a first distal end and extending from a first side of the base portion, and a second retention member having a second distal end and extending from a second side of the base portion opposite the first side, the base portion being configured to be disposed on the bumper flange with the first and second distal ends positioned on opposing sides of the longitudinal axis, the bumper flange extending substantially perpendicularly from the first surface of the mounting plate to a distal free end, and including a portion that is substantially parallel to at least a part of the striker bar; and a latch structure on the lift gate comprising:

a latch configured to engage the striker bar to retain the lift gate in the closed position, and a latch housing covering at least a portion of the latch, the latch housing being positioned between the first and second retention members when the lift gate is in the closed position, the bumper being configured and arranged to form an interference fit with the latch housing, the latch housing having a front surface, a first side surface, and a second side surface, and the bumper having an interior surface with a first portion extending along the first retention member and contacting the first side surface of the latch housing, a second portion extending along the second retention member and contacting the second side surface of the latch housing, and a third portion extending along the base portion and contacting the front surface of the latch housing.

18. The vehicle lift gate assembly according to claim 17, wherein the front surface and first side surface of the latch housing define a first radius, and the front surface and second side surface of the latch housing define a second radius, with the first portion and third portion of the interior surface defining a third radius corresponding to the first radius, and the second portion and third portion of the interior surface defining a fourth radius corresponding to the second radius.

19. The closure panel latch assembly according to claim 1, wherein the striker bar has a second portion extending substantially perpendicularly from the first surface of the mounting plate, a third portion extending substantially perpendicularly from the first surface of the mounting plate, and the first portion extends between the second portion and the third portion, the second portion of the striker bar being positioned closer to the bumper flange than the first and third portions, the first distal end of the first retention member being positioned on an opposite side of the second portion of the striker bar from the second distal end of the second retention member.

20. The closure panel latch assembly according to claim 19, wherein the first portion of the striker bar extends from the second portion to the third portion in a substantially perpendicular direction away from the bumper flange.

* * * * *